US009625846B2

(12) United States Patent
Liu et al.

(10) Patent No.: US 9,625,846 B2
(45) Date of Patent: Apr. 18, 2017

(54) SUSPENSION POLYMERIZATION TONER OF CORE-SHELL STRUCTURE WITH POSITIVE CHARGES AND PREPARATION METHOD

(71) Applicant: SHENZHEN LEPUTAI TECHNOLOGY CO., LTD., Shenzhen, Guangdong (CN)

(72) Inventors: Zhijun Liu, Shenzhen (CN); Yuanyuan Zhang, Shenzhen (CN); Huan Zhang, Shenzhen (CN); Xiao Yuan, Shenzhen (CN); Hong Meng, Shenzhen (CN); Hui Yang, Shenzhen (CN)

(73) Assignee: SHENZHEN LEPUTAI TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 14/655,743

(22) PCT Filed: Apr. 2, 2013

(86) PCT No.: PCT/CN2013/073597
§ 371 (c)(1),
(2) Date: Sep. 18, 2015

(87) PCT Pub. No.: WO2014/101358
PCT Pub. Date: Jul. 3, 2014

(65) Prior Publication Data

US 2016/0026103 A1 Jan. 28, 2016

(30) Foreign Application Priority Data

Dec. 27, 2012 (CN) ..... 2012 1 0579392

(51) Int. Cl.
*G03G 9/08* (2006.01)
*G03G 9/093* (2006.01)

(52) U.S. Cl.
CPC ..... *G03G 9/09392* (2013.01); *G03G 9/0806* (2013.01); *G03G 9/0935* (2013.01);
(Continued)

(58) Field of Classification Search
CPC ..... G03G 9/09392; G03G 9/09307; G03G 9/0935
(Continued)

(56) References Cited

U.S. PATENT DOCUMENTS 5,153,092 A * 10/1992 Kao ..... G03G 9/09335 264/7
2009/0246673 A1* 10/2009 Jung ..... G03G 9/09321 430/110.2

FOREIGN PATENT DOCUMENTS

CN 101075100 A 11/2007
CN 101473274 A 7/2009
CN 102707595 A 10/2012

OTHER PUBLICATIONS

International Search Report of PCT Patent Application No. PCT/CN2013/073597 issued on Oct. 3, 2013.
(Continued)

*Primary Examiner* — Mark A Chapman

(57) ABSTRACT

Suspension polymerization toner of core-shell structure with positive charges comprises core-shell composite particles prepared by mixing composition forming toner core particles with aqueous dispersion liquid, carrying out a heating polymerization reaction to obtain suspension dispersion liquid of toner soft core particles, and carrying out a water-based polymerization reaction to form the core-shell composite particles of which an outer surface of the toner core particles are coated with the rigid shell layer with dense positive charges.

15 Claims, 1 Drawing Sheet

(52) U.S. Cl.
CPC ..... *G03G 9/09307* (2013.01); *G03G 9/09321* (2013.01); *G03G 9/09328* (2013.01); *G03G 9/09364* (2013.01); *G03G 9/09371* (2013.01)

(58) Field of Classification Search
USPC ..... 430/110.2
See application file for complete search history.

(56) References Cited

OTHER PUBLICATIONS

1st Office Action of counterpart Chinese Patent Application No. 201210579392.2 issued on Nov. 22, 2013.

* cited by examiner

SUSPENSION POLYMERIZATION TONER OF CORE-SHELL STRUCTURE WITH POSITIVE CHARGES AND PREPARATION METHOD

TECHNICAL FIELD

The present patent application is related to toner manufacturing, and more particularly, to the suspension polymerization toner of core-shell structure with positive charges prepared by a suspension polymerization process to develop electrostatic charge image and a preparation method thereof.

BACKGROUND

Toner is a developer material for a laser printer or a copy. The operation of a printer is substantially as follows: after exposure, an electrostatic latent image can be formed on the surface of a photosensitive drum charged uniformly. The toner charged by a developing roller and a blade can develop the electrostatic latent image on the surface of the photosensitive drum to form an image. Attracted by opposite charges on the surface of a paper, the image on the surface of photosensitive drum can be transferred and printed on the paper. Then we will get a desired printed image fixed by a heating roller and a pressure roller.

It can be seen from the printing process described above that the toner is charged by the developer roller and the blade, and the charges are obtained by the surface of the toner. The charged toner can develop on the surface of the photosensitive drum to form a pattern to be printed. In order to enable the toner to have a good chargeability, a charge control agent (CCA) is required to be dispersed on the surface of the toner particles as uniformly as possible. Before being transferred and printed from the photosensitive drum to the paper, the toner is required to hold charged state continuously. If the charging characteristic and charge retention capacity of the toner is not good, it is difficult to develop or transfer print. It is also difficult to obtain the image with desired printing effect.

Similarly, the toner should have a number of other properties, such as excellent transfer printing property, low-temperature fixation and storage stability. The toner with a good sphericity has a high transfer printing efficiency, which can be easily transferred and printed from the photosensitive drum to the paper, while reducing or preventing toner remained on the surface of the photosensitive drum. To reduce the environmental impact, toner should fix on the paper at a temperature as low as possible. At the same time the toner should have good storage stability without melt adhesion even exposed to a high temperature condition during being handled or transported. The toner of core-shell structure improves its fixation property by a core with a low glass-transition temperature (low Tg), and enhances blocking resistance by a shell with a high glass-transition temperature (high Tg). By employing such a layer structure, it is possible to meet requirements of both low-temperature fixation and storage stability.

Traditional mechanical pulverizing toner can be obtained by melting and blending resin, CCA, pigment and wax, pulverizing and classifying. Since mechanical pulverizing toner has an irregular shape, the pressure applied by the blade to each toner particles varies, at the same time CCA tends to form a phase separated from a binder resin. Further, CCA particles exposed on the surface of the toner can easily fall off. Therefore, mechanical pulverizing toner is non-uniformly charged and has a very wide charge distribution.

Chinese Patent CN101427186 provides a mechanical pulverizing toner based on styrene/acrylate and polyester binder resin, using a charge control agent of styrene/acrylate which has a good compatibility with the toner. Therefore, the distribution uniformity and retention capacity of charges of the toner has been greatly improved. But it is difficult to meet requirements of low-temperature fixation. Further, the process in which toner particles are collided with one another for 5-20 minutes at 75 to 100 m/s linear velocity to carry out the process of spheroidization consumes a large amount of energy and has high requirement for equipments. Furthermore, it is difficult to obtain a positive spherical toner.

Compared with traditional mechanical pulverizing toners, the conventional suspension polymerization toner can be obtained by dispersing CCA and waxes, pigments and other components together into a monomer uniformly, and carrying out polymerization after high-speed shearing and granulation. The CCA in the toner particles disperses uniformly, and the toner particles have a good sphericity. Thereby, it has a good uniformity of charge distribution and transfer printing efficiency. But the method can still result in a significant amount of CCA distributed in the central region of the toner particles. Charges of the toner can be generated by the friction between the blade and the CCA on the surface of the toner. However the CCA dispersing in the central region of the toner particles does not involve in the friction, it can result in an inefficient use of the CCA. Therefore, there is a need to develop an effective method for increasing the charge density on the surface of the toner.

Chinese Patent CN101473274 provides a toner of core-shell structure which includes a rigid and thin shell layer with dense CCA distributing formed by coating the surface of toner core particles which is prepared by a suspension polymerization process with CCA, using a polymer formed by polymerization reaction of the shell monomer components. The method demands CCA particles being used should be carried out grind and dispersion treatment, and demands the particle diameter distribution thereof should be tightly controlled. It results in a large number of CCA dissociating because of a poor compatibility of CCA and shell resin.

Chinese Patent CN101727031 provides a polymerized toner with high dense charges on the surface which can be obtained by adding a reactive anionic surfactant which contains at least one reactive functional group into aqueous dispersion liquid or adding it at the initial stage of a suspension polymerization reaction, grafting to the surface of the toner particles via polymerization. If the amount of reactive anionic surfactants used in this method is too high, it can result in producing too fine particles in the suspension system, which causes background pollution on the printed images.

SUMMARY

The present patent application aims to overcome deficiencies of the prior art described above, and to provide a suspension polymerization toner of core-shell structure with positive charges which has a good charging property and charge stability.

The present patent application provides a suspension polymerization toner of core-shell structure with positive charges which comprises core-shell composite particles prepared by carrying out a heating polymerization reaction to form suspension dispersion liquid of toner core particles after mixing a composition forming the toner core particles with aqueous dispersion liquid; then mixing a monomer emulsion forming a rigid shell layer, a cationic monomer and the suspension dispersion liquid of the toner soft core particles uniformly; carrying out a water-based polymerization reaction to form the core-shell composite particles of which an outer surface of the toner core particles are coated with a rigid shell layer with dense positive charges. A weight ratio of the rigid shell layer of the core-shell composite particles and the toner soft core particles is 20:80-1:99. An average thickness of the rigid shell layer is 0.05-0.2 μm. A coverage ratio thereof on the outer surface of the toner soft core particles is greater than 50%. The average particle diameter of the core-shell composite particles thus prepared is 5-10 μm. The average sphericity of the particles is 0.950-0.995.

The present patent application also provides a method for preparing the suspension polymerization toner of core-shell structure with positive charges described above. The method includes the following steps of:

(1) preparing a monomer oil phase forming the toner soft core particles and aqueous dispersion liquid for dispersing the monomer oil phase respectively.

(2) mixing the monomer oil phase with the aqueous dispersion liquid according to a certain oil-water ratio (1:2-1:8), transferring the mixture into a reactor after high-speed shearing and suspension granulation, carrying out a first heating polymerization reaction (temperature is 60-95° C., polymerization time is 2-20 hours) to convert monomer oil droplet particles to polymer particles completely, and obtaining the suspension dispersion liquid of the toner soft core particles.

(3) adding a high-Tg shell monomer into water containing an anionic surfactant having the concentration of 0.01~0.5% wt, carrying out high-speed shearing or ultrasound to form a high-Tg shell monomer emulsion having an average particle diameter of 50-200 nm, adding the high-Tg shell monomer emulsion and a cationic monomer into the suspension dispersion system of the toner soft core particles respectively and mixing uniformly, and adding a water-soluble initiator to carry out a second polymerization reaction (temperature is 60-95° C., polymerization time is 2-10 hours), thereby obtaining the core-shell composite particles including the rigid shell layer with dense charges.

(4) cleaning a product until a conductivity of a filtrate being no more than 10 μS/cm, adjusting a pH value of the filtrate to 4.0-6.0 by adding hydrochloric acid solution, further filtrating and drying after soaking for 10-40 minutes, adding an external additive silica, and then obtaining the suspension polymerization toner of core-shell structure with positive charges.

The present patent application provides the suspension polymerization toner of core-shell structure with positive charges comprising a resin layer with dense positive charges which is obtained by carrying out a copolymerization of a cationic monomer having at least one unsaturated double bond and a high-Tg shell monomer. Since the cationic monomer has a good reactivity with the toner shell resin monomer, the resin layer with dense positive charges can coat on the outer surface of the soft toner core particles. Therefore, the resulting toner has a good sphericity, excellent in chargeability and environmental stability, and it can meet the requirements of low-temperature fixation during high-speed printing.

The suspension polymerization toner prepared by the processing method described above, used in a laser imaging device, has a high transfer printing efficiency and image density. There is no pollution on the surface of the photosensitive drum. As the toner is excellent in imaging property, low-temperature fixation property and transfer printing property, it has a wide prospect of application.

DETAILED DESCRIPTION

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the present technology. Thus, the disclosed technology is not intended to be limited to the examples described herein and shown, but is to be accorded the scope consistent with the claims.

Figure 2:
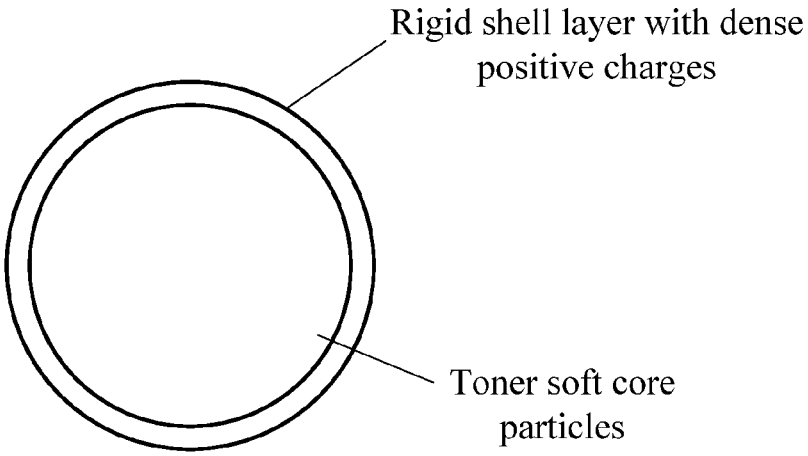
FIG. 2 is a schematic diagram of structure of the prepared suspension polymerization toner particles of core-shell structure with positive charges.

Referring to FIG. 2, the present patent application provides the suspension polymerization toner of core-shell structure with positive charges which comprises core-shell composite particles prepared by mixing a composition forming the toner core particles with aqueous dispersion liquid according to a certain ratio, carrying out a heating polymerization to form the suspension dispersion liquid of toner soft core particles, then mixing a cationic monomer, a high-Tg monomer emulsion forming a rigid shell layer and the suspension dispersion liquid of the toner soft core particles, and carrying out a water-based polymerization reaction to form the core-shell composite particles of which an outer surface of the toner core particles are coated with the rigid shell layer with dense positive charges. Thereby we can obtain the suspension polymerization toner of core-shell structure with positive charges. Thus, obtained by the method including carrying out a copolymerization reaction of a cationic monomer having at least one unsaturated double bond and a high-Tg monomer on the surface of toner to form a rigid resin layer with high dense positive charges, the suspension polymerization toners of core-shell structure with positive charges has a good charging property and charge stability and it is excellent in low-temperature fixation and storage property.

Specifically, the weight ratio of the rigid shell layer of the core-shell composite particles and the toner soft core particles is 20:80-1:99, preferably 15:80-2:99. The average thickness of the rigid shell layer is 0.05-0.2 μm. The coverage rate of the rigid shell layer on the surface of the toner soft core particles is greater than 50%, preferably greater than 80%. If the weight ratio of the rigid shell layer of the core-shell composite particles and the toner soft core particles is less than 1:99, the rigid shell layer cannot coat the surface of the toner soft core particles fully. The adhesion between the toner particles is likely to occur at a high temperature. It results in a decreased storage stability of the toner. If the weight ratio is greater than 20:80, the rigid shell layer of toner is too thick. The temperature which softens the toner will be too high. It results in a reduced firmness of fixation of the toner. It cannot meet requirements of low-temperature fixation.

The present patent application provides the suspension polymerization toner of core-shell structure with positive charges, in which the rigid shell layer resin is a copolymer formed by a polymerization reaction of a cationic monomer and a shell monomer having a high glass-transition temperature. It has a high charge density and a good compatibility with the toner soft core resin. Thereby, it can coat the surface of the toner soft core particles easily. The average particle diameter of the resulting the core-shell composite particles may be 5-10 μm. And the average sphericity may be 0.950-0.995. The suspension polymerization toner employing a core-shell structure with positive charges, when applied to a developing roller and an imaging device, has a high transfer printing efficiency and image density. Further, the image which is printed with the toner is clear and there is no pollution on the background. There is no storage problem while meeting the requirements of fixation at a given temperature. It has better image quality than existing equipments.

Figure 1:
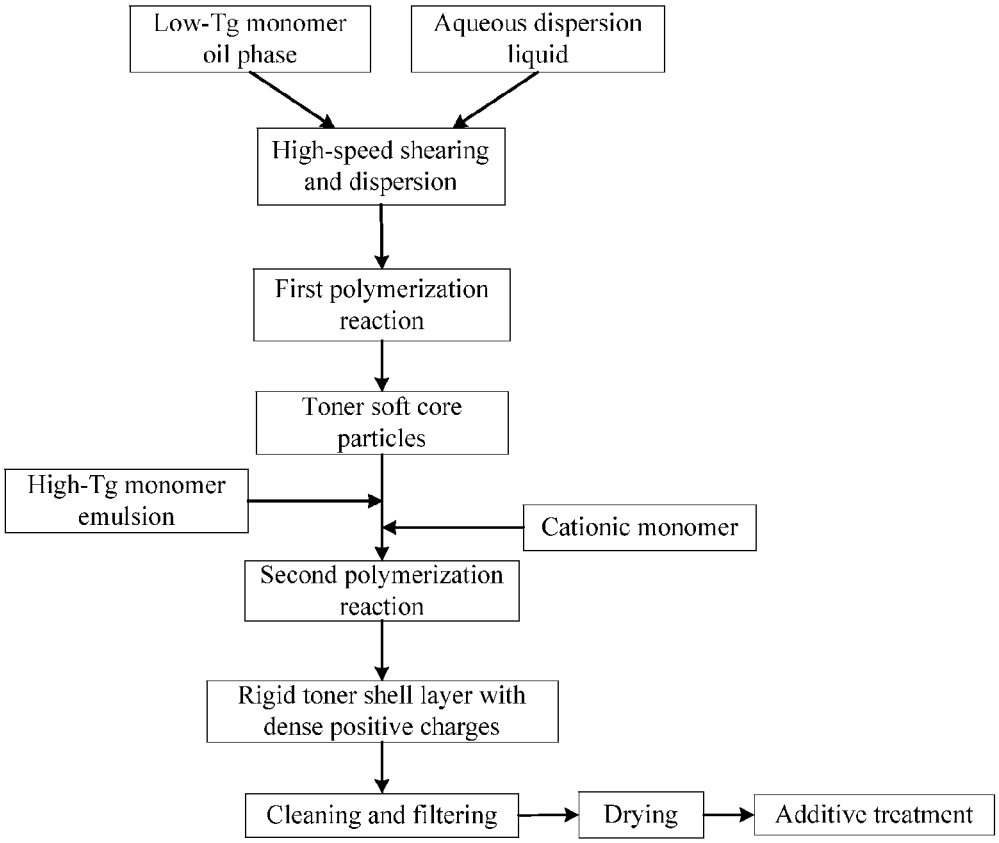
FIG. 1 is a flow chart of the process, according to the present patent application.

Referring to FIG. 1, the method for preparing the suspension polymerization toner of core-shell structure with positive charges provided by the present patent application includes the following steps of:

(1) preparing a monomer oil phase forming the toner soft core particles and aqueous dispersion liquid for dispersing the monomer oil phase respectively;

(2) mixing the monomer oil phase with the aqueous dispersion liquid according to a certain oil-water ratio (1:2-1:8), transferring the mixture into a reactor after high-speed shearing and suspension granulation, carrying out a heating polymerization reaction (temperature is 60-95° C., polymerization time is 2-20 hours) to convert monomer oil droplet particles to polymer particles completely, and obtaining the suspension dispersion liquid of the toner soft core particles.

(3) adding a high-Tg shell monomer into water containing an anionic surfactant having the concentration of 0.01~0.5% wt, carrying out high-speed shearing or ultrasound to form a high-Tg monomer emulsion having the average particle diameter of 50-200 nm, adding the high-Tg monomer emulsion and a cationic monomer into the suspension dispersion system of the toner soft core particles respectively and mixing uniformly, adding a water-soluble initiator to carry out a second polymerization reaction (temperature is 60-95° C., polymerization time is 2-10 hours), and obtaining the core-shell composite particles having a rigid shell layer with dense charges.

(4) cleaning a product until the conductivity of a filtrate being no more than 10 μS/cm, adjusting the pH value of the filtrate to 4.0-6.0 by adding hydrochloric acid solution, further filtrating, drying and adding external additive silica after soaking for a certain period. The suspension polymerization toner of core-shell structure with positive charges can be obtained.

Details of the step described above will be described as follows.

1. Preparation of a Monomer Oil Phase (Components Forming Toner Core Particles)

The components of the toner soft core particles include a soft core resin, a colorant and a release agent.

The preparation process of the monomer oil phase includes the following steps: adding the colorant, the release agent into a monomer forming the toner soft core resin, after uniformly grinding and dispersing with a sand mil, further adding a crosslinker, a molecular weight regulator and an initiator to prepare the monomer oil phase.

In the preparation process of the monomer oil phase according to the present patent application, the monomer forming the toner soft core resin can be primarily selected from a soft core resin monomer. It includes one or more material of the following: styrene, methyl styrene or α-methyl styrene and the like of aromatic vinyl monomers; (methyl) acrylic acid, (methyl)methyl acrylate, (methyl) a ethyl acrylate, (methyl) acrylic acid n-propyl ester, (methyl) butyl acrylate, methcyclohexyl methacrylate, glycidyl methacrylate, hydroxyethyl methacrylate and lauryl methacrylate and the like of acrylate-type monomer. The amount of the core resin component accounts for 40-90% of the toner, which has a decisive influence on the fixation property of the toner. If the glass-transition temperature (Tg) of the toner core resin is too low, the toner can be adhered to the heating roller during printing, which may cause thermal offset problems. If the glass-transition temperature (Tg) of the toner core resin is too high, it cannot be fully melted during printing, which may result in a pool firmness of fixation of the toner on the paper. Therefore, the glass transition temperature of the toner core resin is preferably 40-60° C.

In the preparation process of the monomer oil phase according to the present patent application, the colorants can be selected from at least one material of black pigment, yellow pigment, cyan pigment and magenta pigment. The black pigment can be primarily selected from carbon black pigment having primary particles diameter of 20-40 nm, such as MA-100 (Mitsubishi Chemical Co., Ltd.) #44 (Mitsubishi Chemical Corporation), #52 (Mitsubishi Chemical Corporation), MA7 (Mitsubishi Chemical Corporation), REGAL 300R (Cabot Corporation), REGAL 330R (Cabot Corporation), REGAL 400R (Cabot Corporation), MOGUL L (Cabot Corporation). The cyan pigment can be primarily selected from copper phthalocyanine compounds and derivatives thereof, such as C.I. Pigment Blue 15, 15:1, 15:2, 15:3, 15:4 and the like. The magenta pigment can be primarily selected from azo pigments such as C.I. Pigment Red 31, 48, 57, 58, 63, 68, 114, 122, 146, 150, 163, 187 and 206 and the like. The yellow pigment can be primarily selected from azo pigments, such as C.I. Pigment Yellow 3, 12, 13, 17, 65, 74, 83, 97, 155, 180, 185 and 186 and the like. The amount of the pigment is generally 1-30% wt of the soft core resin monomer, preferably 1-15% wt.

In the preparation process of the monomer oil phase according to the present patent application, the release agent can be primarily selected from one or more material of low molecular weight polyolefin waxes and grease-type synthetic waxes. The polyolefin waxes include polyethylene wax (PE wax) and polypropylene wax (PP wax). The grease-type synthetic waxes include pentaerythrityl tetrastearate, pentaerythritol tetrabehenate, dipentaerythritol hexadipalmitate, dipentaerythritol hexamyristat or dipentaerythritol hexalaurate and the like. The grease-type synthetic waxes which have a hydroxyl value of less than 5 mgKOH/g and an acid value of less than 1 mgKOH/g is preferable. It has a melting point in the range of 50-100° C., preferably 60-80° C. The amount of the release agent is generally 1-40% wt of the soft core resin monomer, preferably 2-20% wt.

In the preparation process of the monomer oil phase according to the present patent application, the crosslinker can be a monomer which contains two or more unsaturated vinyl groups. It includes one or more material of the following: divinylbenzene, divinyl ether, divinyl sulfone, ethylene glycol dimethacrylate, ethylene glycol diacrylate, triethylene glycol dimethacrylate, 1,4-butanedioldimethacrylate, 1,6-hexanedioldimethacrylate, trimethylolpropane triacrylate, trimethylolpropane trimethacrylate, pentaerythritol triacrylate and the like. The crosslinker can be used with the soft core resin monomer together to effectively improve the anti-high-temperature offset property of the toner. The amount of the crosslinker accounts for 0.05-1% wt of the soft core resin monomer. If the amount is too high, the firmness of the toner fixation will be decreased.

In the preparation process of the monomer oil phase according to the present patent application, the molecular weight regulator includes one or more material of the following: 1-dodecanethiol, t-dodecyl mercaptan, carbon tetrachloride or carbon tetrabromide, and etc. The amount of the molecular weight regulator is generally 0.01-5% wt of the soft core resin monomer, preferably 0.1-1% wt. The molecular weight regulator (chain transfer agents) can preferably improve the firmness of the toner. But over dosage can cause decrease of anti-high-temperature offset property and storage property of the toner.

In the preparation process of the monomer oil phase according to the present patent application, the initiator used to polymerize the toner soft core resin monomer is an oil-soluble initiator. Because an oil-soluble initiator can be well dissolved in the soft core resin monomer, it can uniformly distribute into each oil droplet particles. There is almost no difference of resin molecular weight size and distribution among the soft toner core particles obtained from a polymerization reaction. The oil-soluble initiator used in a suspension polymerization includes azo initiators and peroxide initiators. The azo initiators include 2,2'-azobisisoheptonitrile, 2,2'-azoisobutyronitrile, 2,2'-azobis-(2-methylbutyronitrile), dimethyl 2,2'-azobis(2-methylpropionate) and the like; the peroxide initiators include benzoyl peroxide (BPO), dilauroyl peroxide (LPO), tert-butyl peroxy-2-ethylhexanoate, tert-Butyl peroxy diethyl acetate tert-butylperoxyisobutyrate and the like. The oil-soluble initiator can be one or more material described above. The amount of the oil-soluble initiator generally is 0.01-20% wt of the soft core resin monomer, preferably 0.1-10% wt.

2. Preparation of Aqueous Dispersion Liquid:

The suspension dispersant can be employed in the preparation of aqueous dispersion liquid, the suspension dispersant can be selected from one or more material of the following: calcium phosphate, magnesium hydroxide, calcium carbonate, polyvinyl alcohol, and hydroxypropyl methyl cellulose. The dispersion stabilizer which contains a water-insoluble inorganic magnesium hydroxide colloid is preferable. Using the dispersant, polymer particles having a narrow distribution of particles diameter can be obtained. There is a small residual resistance after cleaning. Vivid images can be represented.

Specifically, the preparation process of magnesium hydroxide colloid is as follows: disposing sodium hydroxide and magnesium chloride with deionized water according to 1:1~1:2 molar ratio to form sodium hydroxide solution and magnesium chloride solution respectively, and the volume ratio is preferably 1:1~1:10; then slowly adding the magnesium chloride solution into the sodium hydroxide solution; carrying out high-speed shearing and emulsification with a high-speed emulsifier or pipelined emulsion pump or a combination of both, high-speed shearing for 0.5-2 h, at a high shear line speed of 25-45 m/s, ultrasonic aging time 1-5 h. The concentration of the prepared magnesium hydroxide solution is 0.5~5% wt, and the particle diameter D95 (cumulative value of the number of particle diameter distribution of 95%) is less than 0.8 μm.

3. Process of Suspension Granulation

Suspension granulation stage is a crucial step of the process for preparing toner with the suspension polymerization method. It can directly affect the particle diameter and distribution of the toner.

In the suspension granulation process according to the present patent application, the process includes the following steps: stirring and blending a low-Tg monomer oil phase and aqueous dispersion liquid with the oil-water ratio of 1:2-1:8 to form primary oil droplet particles; and suspension shearing and granulating the mixture of oil and water with a high-speed emulsifier or high-shear emulsification pump. The particle diameter distribution of the oil droplet may range in 3-20 μm, preferably 5-15 μm. The temperature of suspension granulation is preferably 20-60° C.

In the aqueous dispersion liquid, the concentration of the dispersant is preferably 0.5-5% wt of water or the amount of the dispersant accounts for 1-20% wt of the low-Tg monomer oil phase. If the concentration of dispersant is too low or the amount of dispersant is too small, dispersion structure will be unstable. Oil droplet particles are prone to gather, which results in a broadened distribution of particles diameter. If the concentration of the dispersant is too high or the amount of the dispersant is excessive, it is easy to produce large amounts of excessively fine latex particles during high-speed shearing. It is likely to cause background pollution during printing.

In the preparation process described above, the apparatus for shearing and dispersion may include intermittent Ultra-talax T50 (manufactured by IKA Corporation), Clearmix CLM-0.8S (manufactured by M-Technique Corporation.); Continuous Process Pilot 2000 (manufactured by IKA Corporation), and etc. The speed of suspension shearing and granulation may range from 6000 rmp to 25000 rmp. The line speed of high shearing may ranges from 15 m/s to 40 m/s. The desired average particle diameter can be achieved by adjusting the speed of shearing.

4. Process of Polymerization (1) Toner Soft Core Particles

The preparation process includes the following steps: transferring the suspension liquid of oil droplet to a polymerization reactor after suspension granulation; keeping the stirring speed at 50-1000 rpm to disperse and suspend the dispersion liquid droplets, preferably 100-300 rpm; heating to a predetermined temperature after adding nitrogen and removing oxygen; and obtaining the suspension dispersion liquid of the toner soft core particles after carrying out a polymerization for a certain period (first polymerization reaction). The polymerization temperature is preferably 60-95° C. The polymerization time is 2-20 hours, preferably 4-15 hours.

(2) Rigid Shell Layers with Dense Positive Charges

The preparation process includes the following steps: adding a high-Tg monomer into water containing a surfactant having the concentration of 0.01~0.5% wt; carrying out high-speed shearing or ultrasound to form a fine emulsion having the average particle diameter of 50-200 nm (high-Tg monomer emulsion); adding the high-Tg monomer emulsion and a cationic monomer into the suspension dispersion system of the toner soft core particles; and adding a water-soluble initiator to carry out a second polymerization reaction; thereby obtaining the suspension polymerization toner of core-shell structure with positive charges.

The weight ratio of the shell layer of toner of core-shell structure and core particles is preferably 20:80-1:99. The average thickness of the shell layer resin is preferably 0.05-0.2 μm. The coverage rate of the shell layer resin on the surface of core particles is greater than 50%, preferably greater than 80%. Within such ranges, the toner has both storability and low-temperature fixation.

In the polymerization process according to the present patent application, the high-Tg monomer forming the rigid shell layers can be selected from one or more material of monomers of polymer which has a glass transition temperature greater than 80° C. It includes styrene, methyl methacrylate, tertiary-butyl methacrylate and the like. The amount of the high-Tg monomer preferably accounts for 1%~15% wt of the toner soft core particles.

The surfactant is preferably an anionic surfactant, selected from one or more material of the following: potassium laurate, sodium oleate, sodium stearate, octyl sulfate, lauryl sulfate; dodecyl sulfate, dodecyl benzene sulfonate, lauryl sulfonate. The amount of the anionic surfactant accounts for 0.1-5% wt of the high-Tg shell monomer. The average particle diameter of the high-Tg shell monomer emulsion is preferably 50-200 nm. If the amount of the emulsifier is too small, the particles diameter of the emulsion will be too large. It is relatively difficult to be absorbed to the surface of toner core particles. If the amount of the emulsifier is excessive, it is likely to result in a large number of latex particles dissociating.

The cationic monomer is selected from one or more monomer containing amine or ammonium salts. It includes (methyl) N,N-dimethylaminoethyl acrylate, 2-diethylaminoethyl methacrylate, methacryloxyethyltrimethyl ammonium, dimethyl diallyl ammonium chloride, N,N-dimethyl-4-vinylaniline. The amount of the cationic monomer accounts for 0.1-20% wt of the high-Tg shell monomer. If the amount of the cationic monomer is too small, the charge density of the surface of toner will be lower, and the electrified amount of the toner will be low, which may result in the problems of background pollution and insufficient image density. If the amount of the cationic monomer is too high, the hydrophilicity of the polymer formed via a copolymerization reaction of cationic particles and high-Tg shell monomer will be too strong, and it can dissociate in water easily, which may result in difficulty in coating the surface of the toner core particles. The problem of low electrified amount of the toner occurs as well.

Since the cationic monomer has a good solubility in water, it can be directly added to the suspension dispersion liquid of the toner soft core particles. At the same time the cationic monomer has a strong demulsification ability to inhibit generation of free latex particles and facilitate the high-Tg shell monomer to be absorbed to the surface of the toner soft core particles.

The initiator used in a copolymerization reaction to polymerize the cationic monomer and the high-Tg shell monomer is preferably a water-soluble initiator. Since the free radicals of the water-soluble initiator can easily move around the surface of the toner core particles which is absorbed by a shell monomer. It is easy to obtain the toner particles of core-shell structure. The water-soluble initiator of the present patent application can be selected from one or more material of the followings: potassium persulfate, ammonium persulphate, 2,2'-azobis(2-methyl-N-(2-hydroxyethyl) propionamide), 2,2'-azobis(2-methyl-N-(1,1-bis (hydroxymethyl)-2-hydroxyethyl) propionamide). The amount of the water-soluble initiator accounts for 0.5-40% wt of the high-Tg shell monomer, preferably 1-30% wt.

Further, in the present patent application, the crosslinker can be added into the components of the rigid shell layer in order to increase the efficiency of the shell resin coating the toner soft core particles and the hardness of the shell. The crosslinker can be selected from one or more material of the following: divinylbenzene, divinyl ether, divinyl sulfone, ethylene glycol dimethacrylate, triethylene glycol diacrylate, triethylene glycol dimethacrylate, 1,4-butanedioldimethacrylate, 1,6-hexanediol dimethacrylate, trimethylolpropane triacrylate, trimethylolpropane trimethacrylate, pentaerythritol triacrylate, and etc. The amount of the crosslinker accounts for 0.05-5% wt of the high-Tg shell monomer. An excessive amount of crosslinker can cause decrease of the firmness of fixation of the toner.

During carrying out the second polymerization reaction, the polymerization temperature for preparing the shell is preferably 60-95° C. The polymerization time is 2-10 hours, preferably 3-8 hours.

5. Process of Filtrating/Cleaning:

In the process, a large amount of deionized water is required to remove the dispersant. If an inorganic magnesium hydroxide colloid is used as a dispersion stabilizer, firstly, adding an acid to react with magnesium hydroxide; then cleaning with deionized water. The sulfuric acid (preferable), hydrochloric acid, nitric acid and organic acid can be used. The pH of the suspension liquid of the toner particles obtained from polymerization should be adjusted to less than 6.5. Then cleaning and filtrating with a large amount of deionized water can be repeated. When the conductivity of cleaned filtrate is no more than 10 μS/cm, the filtered product is soaked with diluted hydrochloric acid solution having the pH value between 4 and 6 for 10-30 minutes.

The Filtering method includes centrifugation filtration, vacuum filtration, pressure filtration, and etc.

6. Process of Drying:

The process is used to dry the toner particles which have been carried out a cleaning treatment. The dryers for drying treatment for the toner include a vacuum freeze dryer, vacuum dryer, fluidized bed dryer and the like. In order to prevent toner the particles from adhering, the temperature for dry is preferably lower than 50° C.

7. Process of External Additive

The process is used to add an external additive to the toner particles having been carried out the drying process.

The chargeability, fluidity and storage stability of the toner particles can be adjusted by attaching or burying an external additive into the surface of the toner particles.

The external additive for the toner can be selected from one or more material of the following: silicon dioxide, aluminium oxide, titanium dioxide and other inorganic particles. The particles of silicon dioxide and titanium dioxide after hydrophobic modification are preferable. The amount of the additive accounts for 0.1-5% wt of the toner.

Henschel mixer and other well-known mixing apparatus can be used to add the external additive.

The preparation process of the present patent application will be described further in detail in conjunction with specific embodiments as follows.

In the following embodiments, "parts" means weight parts. Evaluation results of examples of the patent application and compared examples are summarized in Table 1.

EXAMPLE 1

81 parts of styrene, 19 parts of n-butylacrylate, 0.3 parts of divinylbenzene, 1.0 part of 1-dodecanethiol, 8 parts of carbon black (NP60, manufactured by Degussa Corporation), and 10 parts of ester wax (WE-5, manufactured by Nippon Oil & Fats Co., Ltd.) are dispersed to prepare a monomer oil phase with a bead mill at room temperature. 7 parts of oil-soluble initiator of tert-butyl peroxy-2-ethylhexanoate are further added, and sufficiently dispersed for 30 minutes.

Additionally, aqueous solution of magnesium chloride formed by dissolving 13 parts of magnesium chloride with 100 parts of deionized water is slowly added into another aqueous solution of sodium hydroxide formed by dissolving 8.3 parts of sodium hydroxide with 200 parts of deionized water; shearing and dispersing at a high speed for 1 h, and ultrasonic aging for 4 h at room temperature. The suspension dispersion liquid of magnesium hydroxide can be obtained. The concentration of magnesium chloride of electrolyte is 1.0% wt of water.

The process includes the following steps: adding the prepared monomer oil phase into the magnesium hydroxide suspension dispersion liquid containing magnesium chloride electrolyte; after shearing with a high-speed disperser (Ultratalax T50, manufactured by IKA) at a speed of 3000 rpm for 5 minutes to form primary oil droplet particles having the average particle diameter of 100 μm; then shearing with a high-speed disperser (Ultratalax T50, manufactured by IKA) at a speed of 9000 rpm for 10 minutes; and transferring it to a nitrogen protective reactor; heating to 90° C. and carrying out a polymerization reaction for 8 hours; and obtaining the suspension dispersion liquid of the toner soft core particles having the average particle diameter of 8.0 μm.

The process further includes the following steps: adding 5 parts of methyl methacrylate, 0.2 parts of 1,4-butanedioldimethacrylate into 30 parts of deionized water which has dissolved with 0.05 parts of sodium dodecyl benzene sulfonate; emulsifying with a high-speed disperser (Ultratalax T50, the IKA) at a speed of 10000 rpm speed for 5 minutes; and adding into the suspension dispersion system to disperse for 30 minutes.

The process further includes the following steps: adding 0.3 parts of methacryloxyethyltrimethyl ammonium chloride (Zibo thousand Fu Chemical Co., Ltd.) into the suspension dispersion liquid of the toner soft core particles to disperse for 10 minutes; then dissolving 1.0 part of ammonium persulfate in 10 parts of deionized water; then adding it into the suspension dispersion system to carry out a polymerization reaction for 5 hours at 90° C.

The process further includes the following steps: removing magnesium hydroxide from the product of polymerization with sulfuric acid solution; then cleaning with a large amount of deionized water repeatedly until the conductivity being no more than 10 μS/cm; Soaking the filtered product with dilute hydrochloric acid solution having the pH value of 5 for 20 minutes after filtering.

The process further includes the following steps: adding 1 part of silicon dioxide RA200HS (12 nm, manufactured by Degussa Corporation), 0.5 part of silicon dioxide TG-C190 (115 nm, manufactured by Degussa) and 0.25 part of titanium dioxide NKT-90 (21 nm, manufactured by Degussa) after drying the product of filter cake to obtain the suspension polymerization toner. Evaluation results of the resulting toner characteristic are shown in Table 1 below.

EXAMPLE 2

The performing procedure of this example is substantially the same with that of Example 1, except changing 0.3 parts of methacryloxyethyltrimethyl ammonium chloride, 5 parts of methyl methacrylate and 0.2 parts of 1,4-butanedioldimethacrylate to 0.5 parts of N,N-dimethyl-4-vinylaniline, 4 parts of styrene and 0.1 parts of divinylbenzene. The suspension polymerization toner of the patent application having the average particle diameter of 8.4 μm can be obtained. Evaluation results of characteristic of the resulting toner are shown in Table 1 below.

EXAMPLE 3

The performing procedure of this example is substantially the same with that of Example 1, except changing 0.3 parts of methacryloxyethyltrimethyl ammonium chloride, 5 parts of methyl methacrylate and 0.2 parts of 1,4-butanedioldimethacrylate to 0.3 parts of dimethylaminoethyl methacrylate (Zibo thousand Fu Chemical Co., Ltd.), 0.2 parts of dimethyl diallyl ammonium chloride (Zibo thousand Fu Chemical Co., Ltd.) and 5 parts of styrene. The suspension polymerization toner of the patent application having the average particle diameter of 8.4 μm can be obtained. Evaluation results of characteristic of the resulting toner are shown in Table 1 below.

COMPARED EXAMPLE 1

83 parts of styrene, 17 parts of n-butylacrylate, 0.5 parts of divinylbenzene, 1.0 part of 1-dodecanethiol, 2 parts of positively charged charge control agent (FCA-201-PS, styrene-acrylic acid copolymer, from Japan Teng warehouse Kasei Co., Ltd.), 7 parts of carbon black (NP60, manufactured by Degussa) and 10 parts of ester wax (WE-5, manufactured by Nippon Oil & Fats Co., Ltd.) are dispersed with a bead mill at room temperature to prepare a monomer oil phase. 7 parts of oil-soluble initiator of tert-butyl peroxy-2-ethylhexanoate are further added, and sufficiently dispersed for 30 minutes.

The process further includes the following steps: additionally, slowly adding an aqueous solution of magnesium chloride formed by dissolving 13 parts of magnesium chloride with 100 parts of deionized water into another aqueous solution of sodium hydroxide formed by dissolving 8.3 parts of sodium hydroxide with 200 parts of deionized water; shearing at a high speed for 1 hour; and ultrasonic aging for 4 hours at room temperature. The suspension dispersion liquid of magnesium hydroxide can be obtained. The concentration of electrolyte of the remaining magnesium chloride is 1% wt of water.

The process further includes the following steps: adding the prepared monomer oil phase into the suspension dispersion liquid of magnesium hydroxide containing magnesium chloride electrolyte; shearing with a high-speed disperser (Ultratalax T50, manufactured by IKA) at a speed of 3000 rpm for 5 minutes to form primary oil droplet particles having the average particles diameter of 100 μm; then shearing with a high-speed disperser (Ultratalax T50, manufactured by IKA) at a speed of 9000 rpm for 10 minutes; then transferring it to a nitrogen protective reactor and heating to 90° C. to carry out a polymerization reaction for 12 hours. The suspension toner having the average particle diameter of 8.2 μm can be obtained.

The process further includes the following steps: removing magnesium hydroxide from the product of polymerization with sulfuric acid solution; then cleaning with a plenty of deionized water until the conductivity of the filtrate being no more than 10 μS/cm.

The process further includes the following steps: after drying the product of filter cake, 1 part of silicon dioxide RA200HS (12 nm, manufactured by Degussa Corporation) and 0.5 parts of silicon dioxide TG-C190 (115 nm, manufactured by Cabot Corporation) are further added. The compared suspension polymerization toner having the average particle diameter of 8.2 μm can be obtained. Evaluation results of characteristic of the resulting toner are shown in Table 1 below.

COMPARED EXAMPLE 2

The performing procedure of this example is substantially the same with that of compared Example 1, except after carrying out a polymerization reaction for 10 hours at 90° C., adding 5 parts of methyl methacrylate into 30 part of deionized water; emulsifying with a high-speed disperser (Ultratalax T50, manufactured by IKA) at a speed of 10000 rpm for 5 minutes; adding the resulting solution to the suspension dispersion system to disperse for 30 minutes; then dissolving 1 part of ammonium persulphate with 10 parts of deionized water; then adding the resulting solution into the suspension dispersion system to carry out a polymerization reaction for 5 hours at 90° C. The compared suspension polymerization toner having the average particle diameter of 8.2 μm can be obtained. Evaluation results of characteristic of the resulting toner are shown in Table 1 below.

COMPARED EXAMPLE 3

The performing procedure of this example is substantially the same with that of Example 1, except changing 0.25 parts of methacryloxyethyltrimethyl ammonium chloride, 5 parts of methyl methacrylate and 0.2 parts of 1,4-butanedioldimethacrylate to 0.5 parts of positively charged charge control agent (TP-415, Hodogaya Chemical Co., Ltd.) which has been grinded and dispersed to have the average particle diameter of 0.2 μm and 5 parts of methyl methacrylate. The compared suspension polymerization toner having the average particle diameter of 8.6 μm can be obtained. Evaluation results of characteristic of the resulting toner are shown in Table 1 below.

COMPARED EXAMPLE 4

The performing procedure of this example is substantially the same with that of Compared Example 2, except firstly adding 0.5 parts of CCAMP-5500 (0.4 μm, manufactured by Soken Chemical Co., Ltd.) to carry out a cover treatment to toner; and adding 1 part of silicon dioxide RA200HS (12 nm, by the Degussa race Co., Ltd.) and silicon dioxide TG-C190 (115 nm, manufactured by Cabot Corporation) to obtain the compared suspension polymerization toner having the average particle diameter of 8.0 μm. Evaluation results of characteristic of the resulting toner are shown in Table 1 below.

Evaluation Methods of Toner:

(1) Particle Diameter Distribution of Toner

The volume average particle diameter of the toner particles forming the present patent application is preferably 5-9 μm. As the volume average particle diameter is in the above range, it improves transfer printing efficiency, image quality involving thin lines, spots and the like.

Specific measurement method is as follows: weighting and measuring about 0.1 g toner particles; placing it in a beaker; adding 0.01 g sodium dodecylbenzenesulfonate and 30 ml deionized water, dispersing it in a dispersion of 60 W ultrasonic for 3 minutes; measuring the number of particles using a coulter particle counter (Multisizer3, manufactured by Beckman Co.) with the pore size at 100 μm and the number of particles reaches 50,000, and measuring volume average particle diameter (Dv) and mean particle diameter (Dn) to calculate particle size distribution (Dv)/(Dn).

(2) Average Sphericity of Toner Particles

From the viewpoint of improving transfer printing efficiency, the average sphericity of the toner particles forming the present patent application is preferably 0.950-0.995.

Specific measurement method is as follows: adding deionized water into a vessel in advance; adding 0.02 g surfactant of sodium dodecylbenzene sulfonate; then adding 0.02 g toner particles; dispersing it in a dispersion of 60 W ultrasonic for 3 minutes; adjusting the concentration of the colorant resin particles to 1000-10000/μL during the measurement. A flow-type particle image analyzer (FPIA-2100, manufactured by Sysmex Corporation) is used for measuring. The average sphericity can be calculated from the measured value. The sphericity can be represented by the following formula (1), and the average sphericity is the mean value thereof.

Sphericity=Circumference equal to the projected area of the particle/Circumference of projected image of particle Formula (1)

(3) pH Value

The measurement method can be as follows: dispersing 5 g toner in 100 g deionized water (pH=6.8); heating and keeping boiling state for 10 minutes; adding deionized water which has been boiled for 10 minutes in advance to replace the volatilized water; cooling to the room temperature (25° C.); measuring the pH value of extract liquor with a mettler pH meter.

(4) Electrified Amount

The measurement method can be as follows: adding the toner into a developing device of printer which runs in 600 dpi high-speed non-magnetic single-component development way; disposing it at the environment of temperature of 23° C. and humidity (N/N) of 50% and at the environment of temperature of 35° C. and humidity of 80% (H/H) for 24 hours respectively; and measuring the electrified amount of the toner with Faraday cage.

(5) Durability

The measurement method can be as follows: adding the toner into a developing device of printer which runs in 600 dpi high-speed non-magnetic single-component development way; continuously printing 5000 pages at 5% concentration, at the environment of temperature of 23° C. and humidity of 50%(N/N), and carrying out a full black printing per 500 pages; and measuring the density of the full black image with a black meter.

(6) Fixation Temperature

Fixing experiments can be carried out using a transformed single component developing printer which can change the temperature of a fixing roller. The fixing test can be carried out as follows: changing the temperature of the printer fixing roller per 5° C.; and measuring the fixing rate of the toner at each temperature. The fixing rate is calculated by the ratio of the image density of printing all black area before and after using the operation of tap stripping. The minimum temperature of the fixing roller at which the fixing rate is greater or equal to 80% can be viewed as the fixation temperature of the toner. If the fixation temperature is low, the toner is suitable for high-speed printing.

(7) Storability

The measurement method can be as follows: adding about 20 g toner into a closed container; taking it out after disposing at temperature of 50° C. for two weeks without destroying the structure as possible; transferring it to a shaker having the mesh size of 500 μm, and the amplitude being set to 1.0 mm; and measuring the weight of the toner remained on the shaker after shaking for 30 seconds. This weight can be viewed as the weight of the agglomeration toner; and calculating ratio of the weight of the agglomeration toner with the weight of toner primarily added into the container. A sample can be measured three times. The average value thereof can be viewed as an indication of the storability. Storability of the toner whose value is small is optimal.

TABLE 1

| | | Example 1 | Example 2 | Example 3 | Compared Example 1 | Compared Example 2 | Comparied Example 3 | Compared Example 4 |
|---|---|---|---|---|---|---|---|---|
| Volume average particle diameter (μm) | | 8.2 | 8.4 | 8.4 | 8.2 | 8.2 | 8.6 | 8.0 |
| Particle diameter distribution ($D_V/D_P$) | | 1.22 | 1.24 | 1.25 | 1.25 | 1.24 | 1.27 | 1.26 |
| Average sphericity | | 0.972 | 0.978 | 0.975 | 0.975 | 0.980 | 0.970 | 0.976 |
| Value of pH | | 6.0 | 5.8 | 6.2 | 6.5 | 6.7 | 6.2 | 6.3 |
| Electrified amount (+μC/g) | 23° C., 50RH % | 26.0 | 29.3 | 28.7 | 23.0 | 10.5 | 20.3 | 23.6 |
| | 35° C., 80RH % | 24.3 | 26.8 | 25.6 | 21.2 | 8.9 | 17.6 | 19.4 |
| Print Density (black print) | Initial density | 1.55 | 1.60 | 1.52 | 1.45 | 0.8 | 1.36 | 1.38 |
| | After printed 5000 pages | 1.47 | 1.50 | 1.48 | 1.35 | 0.5 | 1.0 | 0.9 |
| Surface of photosensitive drum | | Clean | Clean | Clean | Clean | Severe pollution | Slight pollution | Severe pollution |
| Ghost | | no | no | no | Slight | Obvious | Obvious | Obvious |
| Fixation temperature (° C.) | | 140 | 140 | 138 | 125 | 135 | 137 | 135 |
| Storability (%) | | 2 | 2 | 3 | 15 | 3 | 3 | 3 |

From evaluation results of the toner for developing electrostatic charge in Table 1, it can be found that:

Compared Example 1 is the toner of no-core-shell structure. It has a poor storability at a high temperature condition. The fluidity of the toner decreases during long-time printing. It results in a reduced electrified amount and transfer printing efficiency.

The CCA of the toner of core-shell structure of compared example 2 focuses on core particle portion. As being coated with the shell resin, few CCA can be exposed. It results in a low electrified amount and a large amount of residual toner on the surface of photosensitive drum. The density of image is low. There is server bottom ash as well.

The CCA cannot be firmly embedded or absorbed on the surface of toner of core-shell structure of Compared Example 3 and Compared Example 4. It may fall off easily due to a long-time friction. And the charging performance of the toner will be reduced. It has a low image density and poor durability. Furthermore, the CCA particles which have fallen off the surface of toner can form a white film on the photosensitive drum easily. At the same time, the CCA of Compared Example 3 is inorganic particle of a quaternary ammonium salt, which has a undesirable compatibility with the shell resin. Therefore, there are a large number of CCA particles remaining in the suspension dispersion liquid of the toner.

In contrast, the toner of core-shell structure of Example 1-3 of the present patent application has a high electrified amount, environmental stability, transfer printing efficiency and image density. There is no pollution on the surface of photosensitive drum. It meets the requirements of fixation at a given temperature without storability problem.

Various exemplary embodiments are described herein. Reference is made to these examples in a non-limiting sense. They are provided to illustrate more broadly applicable aspects of the disclosed technology. Various changes can be made and equivalents can be substituted without departing from the true spirit and scope of the various embodiments. In addition, many modifications can be made to adapt a particular situation, material, composition of matter, process, process act(s) or step(s) to the objective(s), spirit or scope of the various embodiments. Further, as will be appreciated by those with skill in the art, each of the individual variations described and illustrated herein has discrete components and features which can be readily separated from or combined with the features of any of the other several embodiments without departing from the scope or spirit of the various embodiments.

What is claimed is:

1. A suspension polymerization toner of core-shell structure with positive charges, comprising core-shell composite particles prepared by mixing a composition forming toner core particles with aqueous dispersion liquid, carrying out a heating polymerization reaction to obtain a suspension dispersion liquid of toner soft core particles, then uniformly mixing a monomer emulsion forming a rigid shell layer and a cationic monomer with the suspension dispersion liquid of the toner soft core particles, and carrying out a water-based polymerization reaction to form the core-shell composite particles of which an outer surface of the toner core particles are coated with the rigid shell layer with dense positive charges; wherein a weight ratio of the rigid shell layer of the core-shell composite particles and the toner soft core particles is 20:80-1:99; an average thickness of the rigid shell layer is 0.05-0.2 μm; and a coverage ratio of the rigid shell layer on the outer surface of the toner soft core particles is greater than 50%.

2. The suspension polymerization of core-shell structure with positive charges of claim 1, wherein an average particle diameter of the core-shell composite particles is 5-10 μm; an average sphericity of the core-shell composite particles is 0.950-0.995.

3. A preparation method of the suspension polymerization toner of core-shell structure with positive charges of claim 1, comprising following steps:

(1) preparing a monomer oil phase forming the toner soft core particles and aqueous dispersion for dispersing the monomer oil phase respectively;

(2) mixing the monomer oil phase with the aqueous dispersion liquid according to a certain oil-water ratio, transferring a mixture into a reactor after high-speed shearing and suspension granulation, carrying out a first heating polymerization reaction to convert monomer oil droplet particles to polymer particles completely, and obtaining the suspension dispersion liquid of the toner soft core particles;

(3) adding a high-Tg shell monomer into water containing an anionic surfactant having a concentration of 0.01~0.5% wt, carrying out high-speed shearing or ultrasound to form a high-Tg shell monomer emulsion having an average particle diameter of 50-200 nm, adding the high-Tg shell monomer emulsion and a cationic monomer into suspension dispersion system of the toner soft core particles respectively and mixing uniformly, adding a water-soluble initiator to carry out a second polymerization reaction, then obtaining the core-shell composite particles comprising the rigid shell layer with dense charges; and (4) cleaning a product until a conductivity of a filtrate being no more than 10 μS/cm, adjusting a pH value of the filtrate between 4.0 and 6.0 by adding hydrochloric acid solution and soaking for 10-40 minutes, further filtrating, drying and adding an external additive silica to obtain the suspension polymerization toner of core-shell structure with positive charges.

4. The preparation method for the suspension polymerization toner of core-shell structure with positive charges of claim 3, wherein, in step (1), the monomer oil phase for preparing the toner soft core particles is formed by adding a colorant, a release agent into a soft core resin monomer, grinding and dispersing uniformly with a sand mill, further adding a crosslinker, a molecular weight regulator and an initiator.

5. The preparation method for the suspension polymerization toner of core-shell structure with positive charges of claim 4, wherein the soft resin monomer is primarily selected from one or more material of aromatic vinyl resin monomers or/and acrylic monomers, wherein the aromatic vinyl resin monomer including styrene, methyl styrene or α-methyl styrene, the acrylic monomer including (methyl) acrylic acid, (methyl) methyl acrylate, (methyl) ethyl acrylate, (methyl) acrylic acid n-propyl ester, (methyl) butyl acrylate, methcyclohexyl methacrylate, (methyl) glycidyl methacrylate, (methyl) 2-hydroxyethyl acrylate, or (methyl) lauryl acrylate.

6. The preparation method of the suspension polymerization toner of core-shell structure with positive charges of claim 4, wherein the colorant is selected from at least one material of black pigment, yellow pigment, cyan pigment, and magenta pigment, wherein the black pigment is selected from carbon black pigment having a primary particle diameter of 20-40nm, the cyan pigment is selected from copper phthalocyanine compounds and derivatives thereof, the magenta pigment is selected from azo pigments, and the yellow pigment is selected from azo pigments; the amount of the pigment accounts for 1-20% wt of the soft core resin monomer.

7. The preparation method of the suspension polymerization toner of core-shell structure with positive charges of claim 4, wherein the release agent is selected from one or more of mixtures of a grease-type synthetic waxes which has a hydroxyl of value less than 5 mgKOH/g and an acid of value less than 1 mgKOH/g, and a low molecular weight polyolefin waxes including polyethylene wax and polypropylene wax; a melting point of wax is in the range of 50-100° C., the amount of wax is 1-40% wt of the soft core resin monomer.

8. The preparation method of the suspension polymerization toner of core-shell structure with positive charges of claim 4, wherein the crosslinker contains two or more monomers of unsaturated vinyl groups comprising one or more material of the following: divinylbenzene, divinyl ether, divinyl sulfone, ethylene glycol dimethacrylate, triethylene glycol diacrylate, triethylene glycol dimethacrylate, 1,4-butanedioldimethacrylate, 1,6-hexanedioldimethacrylate, trimethylolpropane triacrylate, trimethylolpropane trimethacrylate or pentaerythritol triacrylate; the amount of the crosslinker accounts for 0.05-1%wt of the soft core resin monomer.

9. The preparation method of the suspension polymerization toner of core-shell structure with positive charges of claim 4, wherein the molecular weight regulator is selected from one or more material of following : 1-dodecanethiol, t-dodecyl mercaptan, carbon tetrachloride or carbon tetrabromide, the amount of the molecular weight regulator accounts for 0.01-5% wt of the soft core resin monomer.

10. The preparation method of the suspension polymerization toner of core-shell structure with positive charges of claim 4, wherein the initiator used to prepare the monomer oil phase of the toner soft core particles is selected from oil-soluble initiators, the amount of the initiator accounts for 0.5-10% wt of the soft core resin monomer.

11. The preparation method of the suspension polymerization toner of core-shell structure with positive charges of claim 3, wherein in step (3), the cationic monomer is selected from one or more monomer containing amine or ammonium salt including (methyl) N,N-dimethylaminoethyl acrylate, 2-diethylaminoethyl methacrylate, methacryloxyethyltrimethyl ammonium chloride, dimethyl diallyl ammonium chloride, N,N-dimethyl-4-vinylaniline, the amount of the cationic monomer accounts for 0.1-10% wt of the high-Tg shell monomer.

12. The preparation method of the suspension polymerization toner of core-shell structure with positive charges of claim 3, wherein in step (3), the high-Tg shell monomer forming the rigid shell layer is selected from one or more material of a polymer monomer whose glass transition temperature is greater than 80° C. including styrene or methacrylate, the amount of the high-Tg shell monomer accounts for 1-15% wt of the toner soft core particles.

13. The preparation method of the suspension polymerization toner of core-shell structure with positive charges of claim 3, wherein in step (3), the surfactant is an anionic surfactant selected from one or more material including potassium laurate, sodium oleate, sodium stearate, octyl sulfate, lauryl sulfate dodecyl sulfate, dodecyl benzenesulfonate, lauryl sulfonate; the amount of the anionic surfactant accounts for 0.1-5% wt of the high-Tg shell monomer.

14. The preparation method of the suspension polymerization toner of core-shell structure with positive charges of claim 3, wherein in step (3), the water-soluble polymerization initiator used for a polymerization reaction is selected from one or more material including potassium persulphate, ammonium persulfate, 2,2'-azobis (2-methyl -N- (2-hydroxyethyl) propionamide), 2, 2'-azobis (2-methyl -N-(1,1- bis (hydroxymethyl) -2-hydroxyethyl) propionamide); the amount of the water-soluble initiator accounts for 0.5-40% wt of the high-Tg shell monomer; polymerization temperature forming shell is 60-95° C., polymerization time is 2-10 hours.

15. The preparation method of the suspension polymerization toner of core-shell structure with positive charges of claim 3, wherein in step (3), the crosslinker is further added during preparation process of the rigid shell layer, the crosslinker comprises the following one or more material including divinylbenzene, divinyl ether, divinyl sulfone, ethylene glycol dimethacrylate, triethylene glycol diacrylate, triethylene glycol dimethacrylate 1,4-butanedioldimethacrylate, 1,6-hexanediol dimethacrylate, trimethylolpropane triacrylate, trimethylolpropane trimethacrylate or pentaerythritol triacrylate, the amount of the crosslinker accounts for 0.05-5% wt of the high-Tg shell monomer.

* * * * *